US009226599B2

(12) United States Patent
Vosshenrich

(10) Patent No.: US 9,226,599 B2
(45) Date of Patent: Jan. 5, 2016

(54) GOODS FEEDING DEVICE

(71) Applicant: POS TUNING UDO VOSSHENRICH GMBH & CO. KG, Bad Salzuflen (DE)

(72) Inventor: Udo Vosshenrich, Bad Salzuflen (DE)

(73) Assignee: POS Tuning Udo Vosshenrich GmbH & Co. KG, Bad Salzufen (DE)

( * ) Notice: Subject to any disclaimer, the term of this patent is extended or adjusted under 35 U.S.C. 154(b) by 0 days.

(21) Appl. No.: 14/561,997

(22) Filed: Dec. 5, 2014

(65) Prior Publication Data

US 2015/0090675 A1 Apr. 2, 2015

Related U.S. Application Data

(63) Continuation-in-part of application No. 12/565,918, filed on Sep. 24, 2009, now abandoned, which is a continuation of application No. PCT/DE2009/001145, filed on Aug. 14, 2009.

(51) Int. Cl.
*A47F 1/12* (2006.01)

(52) U.S. Cl.
CPC ..... *A47F 1/126* (2013.01)

(58) Field of Classification Search
CPC ..... A47F 1/125; A47F 1/126
USPC ..... 414/277; 211/51, 59.3; 312/71
See application file for complete search history.

(56) References Cited

U.S. PATENT DOCUMENTS

| | | | |
|---|---|---|---|
| 4,907,707 | A | 3/1990 | Crum |
| 5,240,125 | A | 8/1993 | Kunz |
| 5,562,217 | A | 10/1996 | Salveson et al. |
| 5,634,564 | A | 6/1997 | Spamer et al. |
| 2007/0194037 | A1 | 8/2007 | Close |
| 2007/0267364 | A1 | 11/2007 | Barkdoll |

FOREIGN PATENT DOCUMENTS

| | | | |
|---|---|---|---|
| DE | 20005638 | U1 | 6/2000 |
| DE | 19808162 | C2 | 3/2001 |
| EP | 1462035 | A2 | 9/2004 |

*Primary Examiner* — Jonathan Snelting
(74) *Attorney, Agent, or Firm* — Laurence A. Greenberg; Werner H. Stemer; Ralph E. Locher

(57) ABSTRACT

The functionality and effectiveness of a goods feeding device for a front carton of a plurality of cartons or goods trays of a shelf-ready packaging system arranged one behind the other on a shelf of a display and storage rack, with goods or goods packaging stored therein, is further improved. The goods feeding device has a pusher plate for the goods on a slide housing which allows a manual rack-loading of deep commercial racks with narrow shelf spacings and a plurality of cartons or goods trays stored one behind the other is made substantially easier. This is achieved by virtue of the fact that the pusher plate is fixed in a height-adjustable manner to the slide housing and can be moved out of an erected work setting into a flattened position.

12 Claims, 4 Drawing Sheets

GOODS FEEDING DEVICE

CROSS-REFERENCE TO RELATED APPLICATION

This application is a continuation-in-part of copending patent application Ser. No. 12/565,918, filed Sep. 24, 2009, which is a continuation application, under 35 U.S.C. §120, of copending international application No. PCT/DE2009/001145, filed Aug. 14, 2009, which designated the United States; the prior applications are herewith incorporated by reference in their entireties.

BACKGROUND OF THE INVENTION

Field of the Invention

The invention relates to a goods feeding device, in particular for a front carton of a plurality of cartons or goods trays of a shelf-ready packaging system arranged one behind the other on a shelf of a multistoried display and storage rack with goods or goods packagings stored therein.

A goods display device for cartons or goods trays of a shelf-ready packaging system (SRP system) contains a goods slide for goods packagings stacked one behind the other on a shelf, a slide housing having a roll spring, which is mounted such that it is rolled up therein and can be drawn out therefrom, and a pusher plate. The goods display device further contains a front anchor for fixing in a front region of a shelf. On the pusher plate thereof a label holder can be mounted which allows the insertion of a goods label and enlarges the active surface of the pusher plate. Such a device is known from published, European patent application EP 1 462 035 A2.

A drawback with this configuration is that, even without the mounted label holder, the pusher plate is still of such a height that, particularly in the case of very narrow shelf spacings, a second or third carton or goods tray of the SRP system cannot easily be lifted over the goods feeding device in order to fill the rear rack regions. Nor is a two-part construction of the goods slide with a separate pusher plate very practical, since loose parts can easily get lost, whereby the goods feeding device as a whole would immediately become unusable.

SUMMARY OF THE INVENTION

It is accordingly an object of the invention to provide a goods feeding device which overcomes the above-mentioned disadvantages of the prior art devices of this general type. The object of the invention relates to further improving the functionality and effectiveness of the goods feeding device and in substantially facilitating a manual rack-loading, in particular of deep commercial racks with narrow shelf spacings, with a plurality of cartons or goods trays of the SRP system stored one behind the other.

With the foregoing and other objects in view there is provided, in accordance with the invention a goods feeding device. The goods feeding device contains a slide housing and a pusher plate for goods on the slide housing, the slide housing and the pusher plate define a goods slide. The goods feeding device further has a carton tray being detachable from and removable from a remainder of the goods feeding device via a form-locking connection. The carton tray has a front carton strip forming part of the form-locking connection. A guide profile is provided for the goods slide, the guide profile is disposed below the carton tray. A front anchor is provided and has a bearing surface or a catch for the pusher plate situated in a tilted state. The front anchor further has a connecting piece connected to but not integral with the guide profile for the goods slide. The connecting piece is lowered relative to a structural height of the guide profile, and the carton tray placed into the goods feeding device is held with the front carton strip in a bottom region, engaged there between the front anchor and the guide profile. The front anchor holds the guide profile at a front side so as to be fixed to a bottom of the rack.

The object is achieved according to the invention by virtue of the fact that the pusher plate is fixed in a height-adjustable manner to the slide housing of the goods slide, whereby the pusher plate can be moved out of an erected or raised, high work setting into a flattened, low servicing position.

Such a construction allows the height of the goods feeding device to be briefly lowered, say, to the height of the slide housing, so that stock cartons or trays to be passed over it rearward onto a shelf can be stowed very much more easily into a rack. A further fundamental advantage consists in the fact that the inventive configuration of the goods feeding device allows the above-situated shelves to be arranged substantially closer together, so that the capacity of a rack can be markedly increased. The movable securement of the pusher plate to the slide housing ensures, moreover, that it cannot accidentally get lost, whereby the working of the goods feeding device is perpetually assured.

In accordance with a particularly preferred embodiment of the subject of the invention, the pusher plate is arranged on the slide housing such that it is pivotable and/or telescopable at least about one axis, so that it can be pivoted or twisted to left or right, forward or rearward, or else can be pushed telescopically downward, whereby the pusher plate can be brought, say, level with the upper end surface of the slide housing.

Particularly advantageous is an embodiment in which the axis is arranged horizontally and at right angles to the motional direction of the goods slide, in particular level with the top edge of the slide housing, so that the upper part of the axially divided pusher plate can be pivoted forward or rearward. The axis could also conceivably be arranged in the lower region of the slide housing, so that the pusher plate, over a large area, could be tilted forward, while an arrangement of the axis horizontally and along the motional direction of the goods slide would also be possible, whereby a lateral deflection of the pusher plate to left or right could be enabled, though, in the case of very narrow goods and thus narrow cartons, the lateral clearance necessary for this might not be available.

According to a particularly advantageous embodiment of the invention, the axis is configured as a film hinge or as some other simple joint construction, so that the complexity of production of the plastic-made goods slide housing is kept within narrow limits and the working of the flattening of the pusher plate is assured over the service life of the goods feeding device without the joint of the axis requiring any type of care or maintenance. The arrangement of the axis in the region of the top edge of the slide housing has a further fundamental advantage, since the rear side of the pusher plate can then be used to shape it, by virtue of the configuration containing at least one or more arc-shaped runners, such that stock cartons or goods trays which are to be passed over the flattened goods slide rearward into a rack can slide over these arc-shaped runners. At the same time, a lower edge of a stock carton to be shelved is reliably prevented from catching on or bumping into an edge of the goods slide.

Preferably, the runners are configured such that, in the upright state of the upper part of the pusher plate, they extend over the pivot axis by the side of the slide housing down to behind the fixed part of the pusher plate and are supported there and, in the flattened state of the pusher plate, are raised over this into the end region of the slide housing.

This increases, on the one hand, the stability of the pusher plate and, on the other hand, the quality of the sliding function, and protects the slide housing from mechanical load.

Also advantageous is a configuration of the front anchor containing a bearing surface or, indeed, a catch for the upper margin of a pusher plate situated in the tilted state, so that the weight of a stock carton which may be briefly deposited onto the goods slide as a rack is filled, not only has to be absorbed by the film hinge, but is diverted via the front anchor into the shelf. The forward tilted pusher plate can be kept tightened by the roll spring also forward into a catch in the front anchor, so that an unwanted erection of the pusher plate as a rack is filled can be reliably prevented.

A further advantageous refinement of the inventive goods feeding device has a front anchor having a connecting piece for a guide profile of the goods slide, which connecting piece is lowered relative to the structural height of the guide profile, so that a carton placed into the goods feeding device is held with a front, transversely running carton strip in the bottom region, engaged there between the front anchor and the guide profile.

Also advantageous is an embodiment of the goods feeding device in which the guide profile has a structural height exceeding the thickness measurement of the carton bottom, so that the goods item, following the introduction of the carton belonging to the SRP system and provided with a bottom and a rear slot, no longer stands on the carton bottom, but on the guide profile, which additionally, on its supporting surface, can be provided with an antifriction coating, thereby further substantially increasing the functional reliability of the goods feeding device and minimizing the necessary feed force. This ensures that, when a front pack is removed, the joint withdrawal of a further pack from the tray or of packs standing in front of a tray, due to high contact pressure of the goods feed, is precluded. The feed force can be chosen sufficiently small that the generated friction forces between the goods packagings are less than the gravitational force of the products. Furthermore, a reduced feed force makes the filling of a rack easier.

Other features which are considered as characteristic for the invention are set forth in the appended claims.

Although the invention is illustrated and described herein as embodied in a goods feeding device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figures 1, 2, 3:
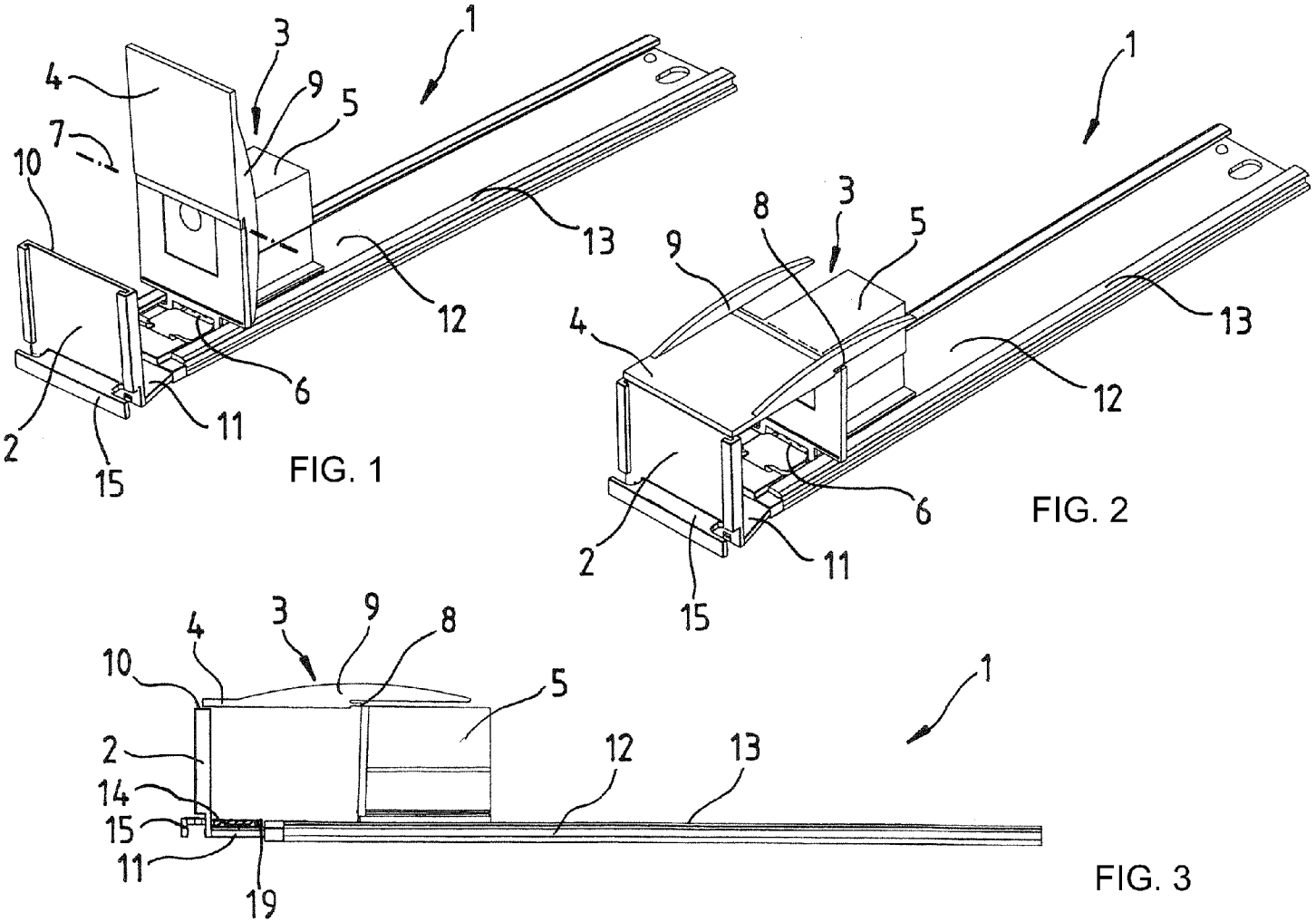
FIG. 1 is a diagrammatic, perspective view of a goods feeding device with an upright pusher plate according to the invention.
FIG. 2 is a perspective view of the goods feeding device according to FIG. 1, with a pivoted or horizontal pusher plate.
FIG. 3 is a side view of the goods feeding device shown in FIG. 2.
Figure 6:
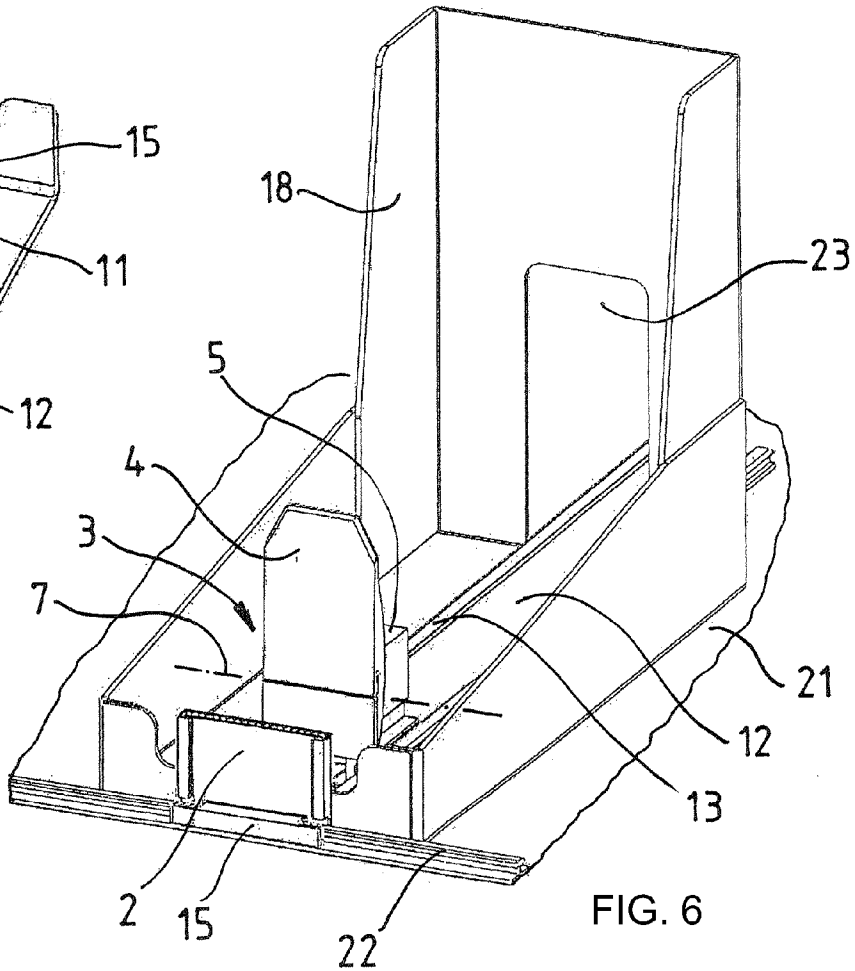
FIG. 6 is a perspective view from diagonally above of the device according to FIG. 5 mounted on a shelf.
Figure 5:
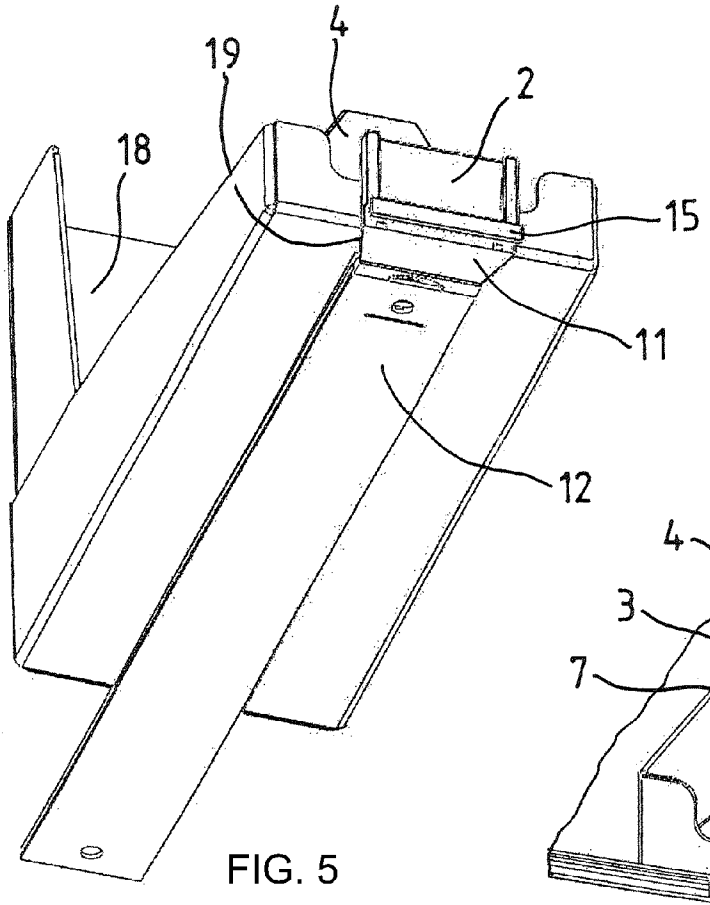
FIG. 5 is a perspective view from diagonally below of the goods tray mounted on the goods feeding device.
Figure 7A:
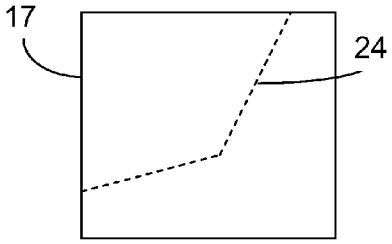
FIG. 7A is a side view of a goods carton showing cut or tear lines on the goods carton to be transformed into the goods feeding tray.
Figure 7B:
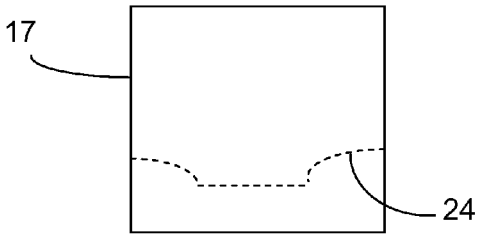
FIG. 7B is a front view of the goods carton showing the cut or tear lines on the goods carton to be transformed into the goods feeding tray.
Figure 7C:
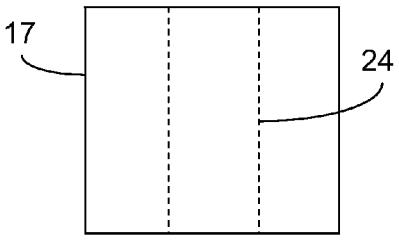
FIG. 7C is a bottom plan view of the goods carton illustrating the cut or tear lines on the goods carton to be transformed into the goods feeding tray.
Figure 7D:
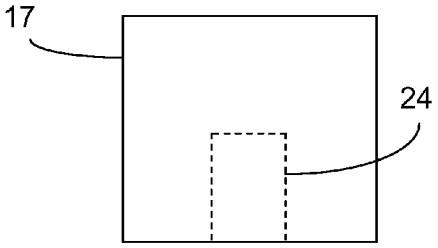
FIG. 7D is a rear view of the goods carton illustrating the cut or tear lines on the goods carton to be transformed into the goods feeding tray.
Figure 7E:
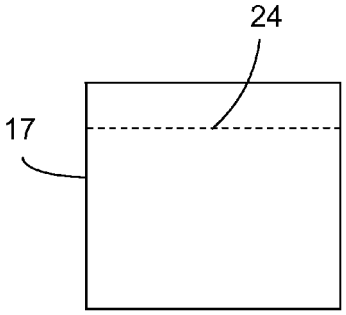
FIG. 7E is a top plan view of the goods carton illustrating the cut or tear lines on the goods carton to be transformed into the goods feeding tray.

Referring now to the figures of the drawing in detail and first, particularly, to FIG. 1 thereof, there is shown a goods feeding device 1 that includes a goods slide 3, which has a pivotable pusher plate 4. An upper part of the pusher plate 4 is articulately attached to a slide housing 5 pivotably about an axis 7, the axis 7 being configured as a film hinge 8. Embodiments having standard joint constructions are likewise possible, but are not diagrammatically represented. The goods feeding device 1 also incorporates a front anchor 2, which on the front side is connected by a connecting piece 11 to a guide profile 12, in which the slide housing 5 is guided. Mounted rolled-up in the slide housing 5 is a roll spring 6, the front end of which is fixed to the front anchor 2. The front anchor 2 has a clip fastening 15 for adaptation systems such as, say, for a clamping rail 22 (see FIG. 6).

The connecting piece 11 has a lesser height than the guide profile 12, so that in a bottom region 14 of a carton/goods tray 18 of a shelf-ready packaging system, which bottom region 14 has a carton strip 19 that can engage the connecting piece 11 and the guide profile 12 in a form-locking manner (see FIG. 3). A form-locking connection is one that connects two elements together due to the shape of the elements themselves.

Figure 4:
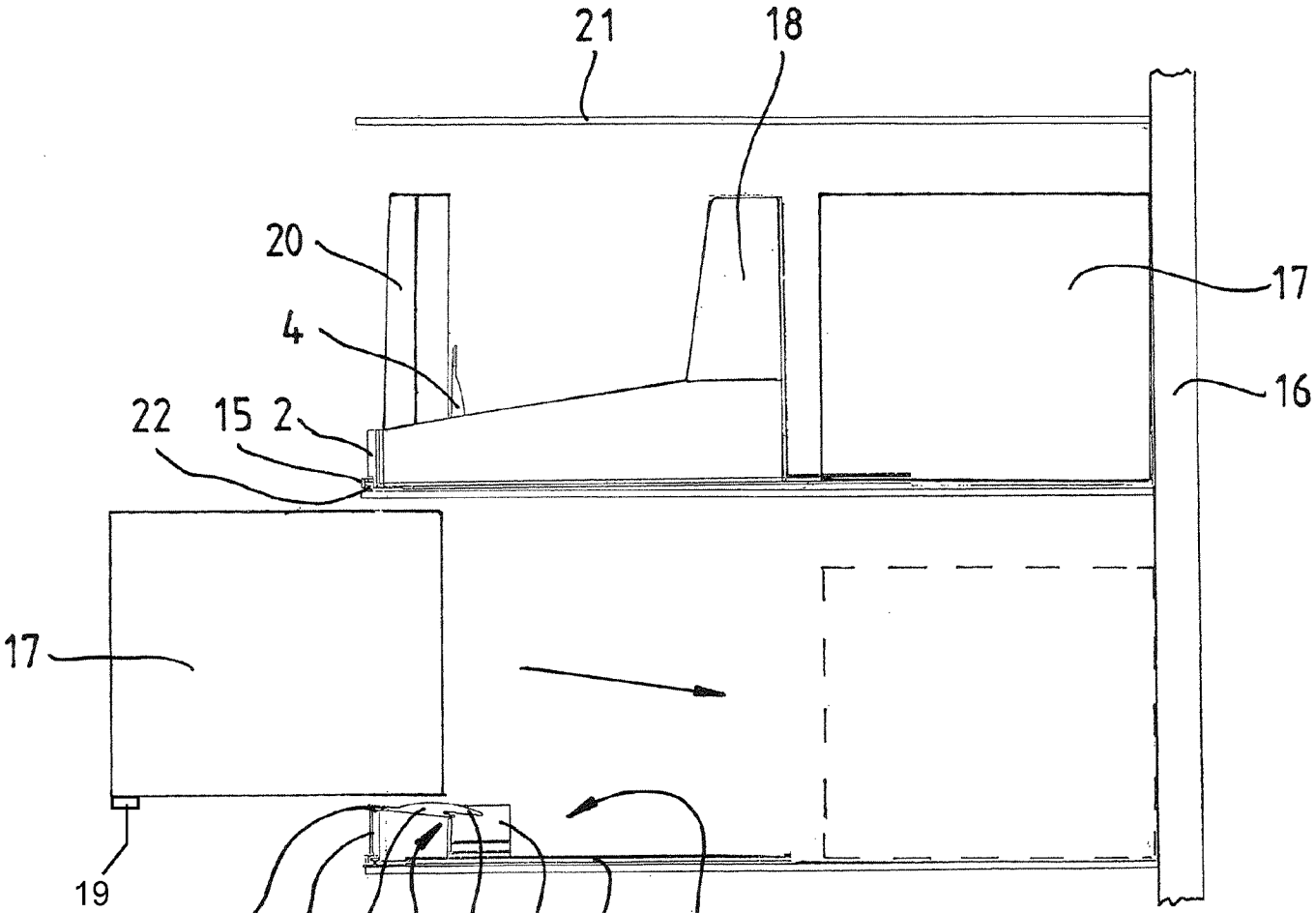
FIG. 4 is a side view of the goods feeding device on a rack showing a goods tray.

When the goods tray 18 is empty of merchandise, it is removed from the goods feeding device 1 and replaced by a new carton 17 (see FIG. 4). At least one carton 17 can be stored behind the goods feeding device 1 for rapid replacement (this of course depends on the shelf space). The new carton 17 must first be modified so that it becomes a new goods tray 18. Ideally, the carton 17 is made of an easily tearable material such as cardboard or a similar light packaging material. As shown in FIGS. 7A-7E, the carton 17 has cutout lines 24 so that parts of the carton 17 can be removed and the modified carton becomes the new goods tray 18 to be placed on the guide profile 12 of the goods feeding device 1. In other words, the new carton 17 is ripped along perforated lines 24 from the top, front, back and bottom and the excess cardboard is removed from the carton 17 transforming it into the goods tray 18. We emphasize once again that the carton 17 itself functions as the goods tray 18. It is further noted that the shapes created by the perforated lines 24 are merely exemplary and many different variations are conceivable.

The guide profile 12 itself also has a height exceeding a bottom thickness measurement of the goods tray 18, so that, when the goods tray 18 provided with a bottom and back cutout 23 is put on, goods 20 stored on the goods tray 18 stand vertically on the guide profile 12. A supporting surface 13 of the guide profile 13 has an anti-friction coating so that the goods 20 easily slide forward on the guide profile 12 when pushed by the slide 3.

It is once again noted that the front anchor 2 with the connecting piece 11 in conjunction with the guide profile 12 of the goods slide 3, which connecting piece 11 is lowered relative to the structural height of the guide profile 12, forms a recess for receiving and engageing the front, transversely running carton strip 19 so that the carton tray 18 placed into the goods feeding device 1 is held with the front, transversely running carton strip 19 in the bottom region, engaged there between the front anchor 2 and the guide profile 12. Please note that FIG. 4 shows the front, transversely running carton strip 19. Whereas FIG. 3 shows just the front, transversely running carton strip 19 without the rest of the carton 17 between the front anchor 2 and the guide profile 12.

In this way, a permanent prior art carton tray can be dispensed with and the packaging of the product itself functions as a temporary carton tray 18. It is further noted that the carton tray 18 is held in place only by a form-locking connection and is thus easily and quickly replaced.

The pusher plate 4 can be pivoted, such as out of an upright position represented in FIGS. 1, 4 (top), 5 and 6, into a flattened or horizontal position as represented in FIGS. 2, 3 and 4 (bottom), the upper margin of the pusher plate 4 resting on a bearing surface 10 of the front anchor 2. On the rearward-facing back of the pusher plate 4 or, in the horizontal state of the goods feeding device 1, upward-facing back of the pusher plate 4, arc-shaped runners 9 are arranged on both sides, which make it easier for a shelf 21 of a rack 16 to be filled, over the goods slide 3, with one or more stock cartons 17, and prevent an accidental canting or catching of a front carton edge on the goods slide 3. The runners 9 are extended from the back of the upper part of the pusher plate 4 such that, in their upright position, they bear on both sides of the slide housing 5 against the back of the fixed part of the pusher plate 4 and are supported there and, in the horizontal state of the pusher plate 4, ensure that the carton 17 is guided to, say, over the slide housing 5, as represented diagrammatically in FIG. 4 (bottom).

The invention claimed is:

1. A goods feeding device to be fixed to a rack, comprising:

a slide housing;

a pusher plate for goods on said slide housing, said slide housing and said pusher plate defining a goods slide;

a carton tray being detachable from and removable from a remainder of the goods feeding device via a form-locking connection, said carton tray having a front carton strip forming part of said form-locking connection;

a guide profile for said goods slide, said guide profile disposed below said carton tray; and a front anchor having one of a bearing surface and a catch for said pusher plate situated in a tilted state, said front anchor further having a connecting piece connected to but not integral with said guide profile for said goods slide, said connecting piece being lowered relative to a structural height of said guide profile, and said carton tray placed into the goods feeding device is held with said front carton strip in a bottom region, engaged there between said front anchor and said guide profile, said front anchor holding said guide profile at a front side so as to be fixed to a bottom of the rack.

2. The goods feeding device according to claim 1, wherein said pusher plate is disposed on said slide housing such that it is at least one of pivotable and telescopable about at least one axis.

3. The goods feeding device according to claim 2, wherein said axis lies horizontally and at right angles to a motional direction of said goods slide.

4. The goods feeding device according to claim 3, wherein said axis is arranged level with a top side of said slide housing and said pusher plate is horizontally divided along said axis and has an upper part that can be pivoted forward or rearward.

5. The goods feeding device according to claim 4, further comprising one of a film hinge and some other joint defining said axis.

6. The goods feeding device according to claim 4, wherein said pusher plate is a forward-tiltable pusher plate and a back of said upper part of said forward-tiltable pusher plate has at least one arc-shaped runner for a stock carton of a shelf-ready packaging system, the stock carton to be passed over said goods slide rearward into a rack.

7. The goods feeding device according to claim 6, wherein in an upright state of said pusher plate, said arc-shaped runner extends over said axis alongside said slide housing down to behind a fixed part of said pusher plate and is supported there and, in the flattened state, is raised over said pusher plate into an end region of said slide housing.

8. The goods feeding device according to claim 1, wherein said structural height of said guide profile exceeds a thickness measurement of a carton bottom of said carton tray, and in that the goods, when said carton tray of a shelf-ready packaging system, said carton tray having a bottom and back cutout formed therein, is in a state of having been placed into the goods feeding device, stands vertically on said guide profile.

9. The goods feeding device according to claim 8, wherein said guide profile has a supporting surface for supporting the goods, said supporting surface having an antifriction coating.

10. The goods feeding device according to claim 1, wherein the goods feeding device is for a front carton of a plurality of cartons or goods trays of a shelf-ready packaging system disposed one behind the other on a shelf of a multi-storied display and storage rack, with the goods or goods packagings stored therein.

11. The goods feeding device according to claim 1, wherein said pusher plate is fixed in a height-adjustable manner to said slide housing and can be moved out of an erected work setting into a flattened position.

12. A goods feeding device to be fixed to a shelf, comprising:

a slide housing;

a pusher plate for goods on said slide housing, said slide housing and said pusher plate defining a goods slide for reveiving a disposeable carton tray being detachable from and removable from a remainder of the goods feeding device via a form-locking connection, the carton tray having a front carton strip forming part of said form-locking connection;

a guide profile for said goods slide, said guide profile disposed below the disposeable; and a front anchor having one of a bearing surface and a catch for said pusher plate situated in a tilted state, said front anchor further having a connecting piece connected to but not integral with said guide profile for said goods slide, said connecting piece being lowered relative to a structural height of said guide profile, and the disposable carton tray placed into the goods feeding device is held with said front carton strip in a bottom region, engaged there between said front anchor and said guide profile, said front anchor holding said guide profile at a front side so as to be fixed to a bottom of the rack.

* * * * *